US006309808B1

(12) United States Patent
D'hont et al.

(10) Patent No.: US 6,309,808 B1
(45) Date of Patent: Oct. 30, 2001

(54) HEAT MODE RECORDING ELEMENT

(75) Inventors: Dirk D'hont, Mortsel; Luc Voet, St. Katelijne-Waver; Luc Leenders, Herentals, all of (BE)

(73) Assignee: Agfa-Cevaert, Mortsel (BE)

( * ) Notice: Subject to any disclaimer, the term of this patent is extended or adjusted under 35 U.S.C. 154(b) by 0 days.

(21) Appl. No.: 08/435,224

(22) Filed: May 5, 1995

(30) Foreign Application Priority Data

May 25, 1994 (EP) ..... 94201472

(51) Int. Cl.[7] ..... G03C 1/76; G03C 5/04

(52) U.S. Cl. ..... 430/346; 430/348; 430/496; 430/523; 430/945; 430/950; 428/209; 428/913; 346/135.1

(58) Field of Search ..... 430/346, 496, 430/945, 523, 271.1, 276.1, 524, 348, 944, 330, 950; 428/209, 913; 346/135.1

(56) References Cited

U.S. PATENT DOCUMENTS 4,388,400 * 6/1983 Tabei et al. ..... 430/346
4,499,178 * 2/1985 Wada et al. ..... 430/395
4,711,838 * 12/1987 Grzeskowiak et al. ..... 430/523
5,017,449 * 5/1991 Yoshihara ..... 430/59

OTHER PUBLICATIONS

Patent Abstracts of Japan, vol. 16, No. 137, Apr. 7, 1992 and JP–A–03 297688, Dec. 27, 1991.

* cited by examiner

*Primary Examiner*—Thorl Chea
(74) *Attorney, Agent, or Firm*—Breiner & Breiner, L.L.C.

(57) ABSTRACT

A heat mode recording element is disclosed comprising a metal recording layer, preferably a bismuth layer, and a layer containing a roughening agent underneath the metal layer. An image is formed by exposure with intense laser light and the presence of the roughening agent reduces or eliminates interference patterns.

In an alternative embodiment a roughened support is used instead of a layer containing a roughening agent.

11 Claims, No Drawings

HEAT MODE RECORDING ELEMENT

FIELD OF THE INVENTION

The present invention relates to an improved heat mode recording element containing a thin metal recording layer.

BACKGROUND OF THE INVENTION

Recording materials have been disclosed on which records are made thermally by the use of intense radiation like laser beams having a high energy density. In such thermal recording or heat mode recording materials information is recorded by creating differences in reflection and/or in transmission optical density on the recording layer. The recording layer has high optical density and absorbs radiation beams which impinge thereon. The conversion of radiation into heat brings about a local temperature rise, causing a thermal change such as evaporation or ablation to take place in the recording layer. As a result, the irradiated parts of the recording layer are totally or partially removed, and a difference in optical density is formed between the irradiated parts and the unirradiated parts (cf. U.S. Pat. Nos. 4,216,501, 4,233,626, 4,188,214 and 4,291,119 and British Pat. No. 2,026,346)

The recording layer of such heat mode recording materials is usually made of metals, dyes, or polymers. Recording materials like this are described in "Electron, Ion and Laser Beam Technology", by M. L. Levene et al.; The Proceedings of the Eleventh Symposium (1969); "Electronics" (Mar. 18, 1968), P. 50; "The Bell System Technical Journal", by D. Maydan, Vol. 50 (1971), P. 1761; and "Science", by C. O. Carlson, Vol. 154 (1966), P. 1550.

Recording on such thermal recording materials is usually accomplished by converting the information to be recorded into electrical time series signals and scanning the recording material with a laser beam which is modulated in accordance with the signals. This method is advantageous in that recording images can be obtained on real time (i.e. instantaneously). Recording materials of this type are called "direct read after write" (DRAW) materials. DRAW recording materials can be used as a medium for recording an imagewise modulated laser beam to produce a human readable or machine readable record. Human readable records are e.g. micro-images that can be read on enlargement and projection. An example of a machine readable DRAW recording material is the optical disc. To date for the production of optical discs tellurium and its alloys have been used most widely to form highly reflective thin metal films wherein heating with laser beam locally reduces reflectivity by pit formation (ref. e.g. the periodical 'Physik in unserer Zeit', 15. Jahrg. 1984/Nr. 5, 129–130 the article "Optische Datenspeicher" by Jochen Fricke). Tellurium is toxic and has poor archival properties because of its sensitivity to oxygen and humidity. Other metals suited for use in DRAW heat-mode recording are given in U.S. Pat. No. 4,499,178 and U.S. Pat. No. 4,388,400. To avoid the toxicity problem other relatively low melting metals such as bismuth have been introduced in the production of a heat-mode recording layer. By exposing such a recording element very shortly by pulses of a high-power laser the radiation is converted into heat on striking the bismuth layer surface. As a result the writing spot ablates or melts a small amount of the bismuth layer. On melting the layer contracts on the heated spot by surface tension thus forming small cavitations or holes. As a result light can pass through these cavitations and the density is lowered to a certain Dmin value depending on the laser energy irradiated.

Heat mode recording materials usually do not require development and fixing processes and do not require darkroom operations because of their insensitivity to room light. Therefore they constitute a valuable alternative to conventional photosensitive materials based on silver halide emulsions, e.g. for phototype-setting or image-setting applications. As is generally known silver halide materials have the advantage of high potential intrinsic sensitivity and excellent image quality. On the other hand they show the drawback of requiring several wet processing steps employing chemical ingredients which are suspect from an ecological point of view. For instance the commonly used developing agent hydroquinone is allergenic and the biodegradation of disposed phenidone is too slow. As a consequence it is undesirable that depleted solutions of this kind would be discharged into the public sewerage; they have to be collected and destroyed by combustion, a cumbersome and expensive process.

However, recording elements based on a thin metal layer show the drawback that the thin metal film may reflect more than 50% of the laser radiation, wasting the energy of the laser radiation. Accordingly, such material may require a substantial amount of energy for recording. Therefore, a high output laser light source is required if records are to be made by high-speed scanning. Methods to reduce reflectance are proposed in the Japanese Unexamined Patent Publications Nos. 40479/71 and 74632/76. However the proposed solutions have other drawbacks. Moreover, due to the high specular reflectance interference patterns arise with periods depending on the thickness of the protective cover usually present to protect the scratch-sensitive metal layer. As a consequence of these interference phenomena the finished image has an uneven and splodgy appearance.

It is an object of the present invention to provide an improved heat mode recording element based on a thin metal layer which shows reduced or no interference patterns on laser recording.

It is a further object of the present invention to provide a method for the formation of a heat mode image which has no uneven or splodgy appearance.

SUMMARY OF THE INVENTION

The objects of the present invention are realized by providing a heat mode recording element comprising, in order:

(a) a support,
(b) a layer containing a roughening agent,
(c) a metal recording layer,
(d) a protective element.

In a preferred embodiment the metal layer is a vacuum-deposited thin bismuth layer having a thickness preferably comprised between 0.1 and 0.6 $\mu$m. The average particle size of the roughening agent preferably ranges between 0.3 and 2.0 $\mu$m, most preferably around 1.0 $\mu$m. A preferred roughening agent is composed of polymethylmethacrylate beads.

The layer containing the roughening agent can be the subbing layer of the support or can be an extra layer between the subbing layer and the metal layer.

The protective element preferably comprises a cover sheet and an adhesive layer.

DETAILED DESCRIPTION OF THE INVENTION

The different elements constituting the heat mode recording material of the present invention will now be explained in more detail.

Although the support of the heat mode element can in principle be an opaque paper base preference is given to a transparent organic resin support. Useful transparent organic resin supports include e.g. cellulose nitrate film. cellulose acetate film, polyvinylacetal film, polystyrene film, polyethylene terephthalate film, polycarbonate film, polyvinylchloride film or poly-Alpha-olefin films such as polyethylene or polypropylene film. The thickness of such organic resin film is preferably comprised between 0.07 and 0.35 mm. In a most preferred embodiment of the present invention the support is a polyethylene terephthalate layer provided with a subbing layer.

The layer containing the roughening agent can be the subbing layer itself applied to the support or can be an extra layer between the subbing layer and the metal layer.

In principle layer (b) can contain no binder at all but preferably it contains a binder. Tis layer (b) can be coated in principle from an organic solvent or from an aqueous medium depending on the chemical nature of the binder. Organic solvent-soluble binders include e.g. polymers derived from α,β-ethylenically unsaturated compounds such as e.g. polymethyl methacrylate, polyvinyl chloride, a vinylidene chloride-vinyl chloride copolymer, polyvinyl acetate, a vinyl acetate-vinyl chloride copolymer, a vinylidene chloride-acrylonitrile copolymer, a styrene-acrylonitrile copolymer, chlorinated polyethylene, chlorinated polypropylene, a polyester, a polyamide, polyvinylbutyral etc. Several organic solvents can be used for dissolving and coating these polymers. On the other hand water-soluble binders coatable from an aqueous medium can be used, e.g. gelatin, polyvinyl alcohol, polyvinyl pyrrolidone, carboxymethyl cellulose, methyl cellulose, ethyl cellulose, gum arabic, casein, different kinds of water-soluble latices, etc.

In a preferred embodiment the roughening agent is incorporated in the subbing layer applied to the polyester support, in other words this subbing layer constitutes layer (b). This subbing layer can be applied before or after stretching of the polyester film support. The polyester film support is preferably biaxially stretched at an elevated temperature of e.g. 70–120° C., reducing its thickness by about ½ to ⅓ or more and increasing its area 2 to 9 times. The stretching may be accomplished in two stages, transversal and longitudinal in either order or simultaneously. The subbing layer is preferably applied by aqueous coating between the longitudinal and transversal stretch, in a thickness of 0.1 to 5 μm. In case of a bismuth recording layer the subbing layer preferably contains, as described in European Patent Application EP 0 464 906, a homopolymer or copolymer of a monomer comprising covalently bound chlorine. Examples of said homopolymers or copolymers suitable for use in the subbing layer are e.g. polyvinyl chloride, polyvinylidene chloride, a copolymer of vinylidene chloride, an acrylic ester and itaconic acid, a copolymer of vinyl chloride and vinylidene chloride, a copolymer of vinyl chloride and vinyl acetate, a copolymer of butylacrylate, vinyl acetate and vinyl chloride or vinylidene chloride, a copolymer of vinyl chloride, vinylidene chloride and itaconic acid, a copolymer of vinyl chloride, vinyl acetate and vinyl alcohol etc.. Polymers that are water dispersable are preferred since they allow aqueous coating of the subbing layer which is ecologically advantageous.

Said homopolymer or copolymer may be prepared by various polymerization methods of the constituting monomers. For example, the polymerization may be conducted in aqueous dispersion containing a catalyst and activator, e.g., sodium persulphate and meta sodium bisulphite, and an emulsifying and/or dispersing agent. Alternatively, the homopolymers or copolymers used with the present invention may be prepared by polymerization of the monomeric components in the bulk without added diluent, or the monomers may be reacted in appropriate organic solvent reaction media.

The roughening agent incorporated in layer (b)—for many actual substances this term will be equivalent to the more familiar terms "matting agent" or "spacing agent", but the term is chosen for its functional aspect—must fulfil several requirements for the successful practice of the present invention. Chemical nature, concentration and particle distribution of the roughening agent must be chosen in such a way that a certain degree of unevenness can be introduced in the metal recording layer. It is shown that this unevenness can reduce the occurrence of interference patterns because the reflectance gets more diffuse. It will be clear that the roughening agent must be closely packed in the layer. It will also be easily understood that the thickness of layer (b), the average particle size and the coverage of the roughening agent must be tuned to each other in such a way that a sufficient number of the roughening particles must protrude above the interface layer (b)/metal layer in order to induce local deformation spots into this metal layer. When the average particle size is too low the roughening agent will not be able to introduce unevenness in the metal layer. When the average particle size is too great too high a coverage will be required which would make layer (b) too thick. So it is clear that an optimal particle size should be chosen for the roughening agent and that this optimum will depend on the mechanical strength of the metal layer and therefore on its thickness. For the preferred embodiment of a bismuth layer with a thickness of about 0.3 μm the average particle size of the roughening agent preferably ranges from 0.3 to 2.0 μm, and is most preferably about 1.0 μm. In this case the coverage of the roughening agent preferably ranges from 0.05 to 1.0 g/m$^2$, and is most preferably about 0.6 g/m$^2$.

It will also be clear that the optimal amount/m$^2$ of the binder will be dependent on the average particle size of the roughening agent.

The degree of roughness of layer (b) is best characterized by the so-called $R_a$ value. This so-called average roughness value is defined as the arithmic average value of the absolute amounts of all the measured distances of the roughness profile from the middle line within the measured interval. Layer (b) preferably has a $R_a$ value of at least 0.2 μm.

The roughening agent can be chosen from a wide variety of chemical classes and commercial products provided the particles chosen show an excellent mechanical and thermal stability. Preferred roughening agents include following:

the spherical polymeric beads disclosed in U.S. Pat. No. 4,861,818;

the alkali-soluble beads of U.S. Pat. No. 4,906,560 and EP 0 584 407;

the insoluble polymeric beads disclosed in EP 0 466 982;

polymethylmethacrylate beads;

copolymers of methacrylic acid with methyl- or ethylmethacrylate;

TOSPEARL siloxane particles (e.g. types T105, T108, T103, T120), marketed by Toshiba Co;

SEAHOSTAR polysiloxane—silica particles (e.g. type KE-P50), marketed by Nippon Shokubai Co;

ROPAQUE particles, being polymeric hollow spherical core/sheat beads, marketed by Rohm and Haas Co, and described e.g. is U.S. Pat. Nos. 4,427,836, 4,468,498 and 4,469,825;

ABD PULVER, marketed by BASF AG;

CHEMIPEARL, spherical poymeric particles, marketed by Misui Petrochemical Industries, Ltd.

In principle, a thin intermediate layer can be applied between layer (b) and the metal recording layer for reasons of protection against physical damage. In this case the thin intermediate layer is coated together with layer (b) by slide hopper coating. It can contain the same kinds of binder as layer (b) at a coverage of lower than 1 $g/m^2$ in order not to lose the roughening effect. However in a preferred embodiment there is no such an intermediate layer and the metal recording layer is positioned immediately on top of layer (b) in order to get the full effect of the unevenness introduced by the roughening agent.

Possible metals for the recording layers in this invention include Mg, Sc, Y, Ti, Zr, Hf, V, Nb, Ta, Cr, Mo, W, Mn, Re, Fe, Co, Ni, Ru, Rh, Pd, Ir, Pt, Cu, Ag, Au, Zn, Cd, Al, Ga, In, Si, Ge, Sn, As, Sb, Bi, Se, Te. These metals can be used alone or as a mixture or alloy of at least two metals thereof. Due to their low melting point Mg, Zn, In, Sn, Bi and Te are preferred. The most preferred metal for the practice of this invention is Bi.

The metal recording layer may be applied on top of the layer containing the roughening agent by vapor deposition, sputtering, ion plating, chemical vapor deposition, electrolytic plating, or electroless plating. In the preferred case of Bi the recording layer is preferably provided by vapor deposition in vacuo. A method and an apparatus for such a deposition are disclosed in EP 0 384 041.

The thickness of this Bi layer is preferably comprised between 0.1 and 0.6 $\mu$m. When this thickness is too low the recorded images do not have sufficient density. When on the other hand the thickness is too high the sensitivity tends to decrease and the minimal density, i.e. the density after laser recording on the exposed areas tends to be higher.

Since the metal layer is very sensitive to mechanical damage a protective element must be provided on top of the metal layer. In a preferred embodiment this protective element comprises a transparent organic resin, acting as cover sheet, and an adhesive layer. A method for applying such a protective element by lamination in the same vacuum environment as wherein the deposition of the metal layer took place is disclosed in EP 0 384 041, cited above. The cover sheet can be chosen from the group of polymeric resins usable for the support of the heat mode element. In a preferred embodiment the cover sheet is also polyethylene terephthalate but preferably substantially thinner than the polyethylene terephthalate of the support.

For the adherence of the hard protective outermost resin layer to the heat mode recording layer preferably a layer of a pressure-sensitive adhesive resin can be used. Examples of such resins are described in U.S. Pat. No. 4,033,770 for use in the production of adhesive transfers (decalcomanias) by the silver complex diffusion transfer process, in the Canadian Patent 728,607 and in the U.S. Pat. No. 3,131,106.

Pressure-sensitive adhesives are usually composed of (a) thermoplastic polymer(s) having some elasticity and tackiness at room temperature (about 20° C.), which is controlled optionally with a plasticizer and/or tackifying resin. A thermoplastic polymer is completely plastic if there is no recovery on removal of stress and completely elastic if recovery is instantaneous and complete.

Particularly suitable pressure-sensitive adhesives are selected from the group of polyterpene resins, low density polyethylene, a copoly(ethylene/vinyl acetate), a poly ($C_1$–$C_{16}$)alkyl acrylate, a mixture of poly($C_1$–$C_{16}$)alkyl acrylate with polyvinyl acetate, and copoly(vinylacetate-acrylate) being tacky at 20° C.

In the production of a pressure-adhesive layer an intrinsically non-tacky polymer may be tackified by the adding of a tackifying substance, e.g. plasticizer or other tackifying resin.

Examples of suitable tackifying resins are the terpene tackifying resins described in the periodical "Adhesives Age", Vol. 31, No. 12, November 1988, p. 28–29.

According to another embodiment the protective element is laminated or adhered to the heat-mode recording layer by means of a heat-sensitive also called heat-activatable adhesive layer or thermoadhesive layer, examples of which are described also in U.S. Pat. No. 4,033,770. In such embodiment the laminating material consisting of adhesive layer and abrasion resistant protective layer and/or the recording web material to be protected by lamination are heated in their contacting area to a temperature beyond the softening point of the adhesive. Heat may be supplied by electrical energy to at least one of the rollers between which the laminate is formed or it may be supplied by means of infra-red radiation. The laminating may proceed likewise by heat generated by high-frequency micro-waves as described e.g. in published EP-A 0 278 818 directed to a method for applying a plastic covering layer to documents.

A survey of pressure and/or heat-sensitive adhesives is given by J. Shields in "Adhesives Handbook", 3rd. ed. (1984). Butterworths—London, Boston, and by Ernest W. Flick in "Handbook of Adhesive Raw Materials"(1982). Noyens Publications, Park Ridge, N.J.—USA.

The adhesive layer may be heat-curable or ultra-violet radiation curable. For heat-curable organic resins and curing agents therefore reference is made e.g. to the above mentioned "Handbook of Adhesive Raw Materials", and for UV curable resin layers reference is made e.g. to "UV Curing: Science and Technology"—Technology Marketing Corporation, 642 Westover Road—Stanford—Conn.—USA—06902 (1979). However, in heat mode recording with a meltable metal layer preference is given to an easily deformable adhesive layer so that it does not form a hindrance for the formation of small metal globules in the areas of the recording layer struck by high intensity radiation energy laser energy. The easy deformability of the adhesive interlayer is in favour of recording sensitivity.

For several applications of a heat mode DRAW material such as the one of the present invention the dimensional stability is of utmost importance. Fields of application where the requirements for dimensional stability are very stringent are e.g. those where the heat moded image serves as an intermediate for the exposure of a lithographic printing plate, or as a master mask for the production of microelectronic integrated circuits or printed circuit boards (PCB). To improve the dimensional stablility one or more barrier layers can be applied onto the heat mode recording element retarding the uptake of water vapour as disclosed in European Patent Application Appl. No. 93201366, filed May 12, 1993. In a preferred embodiment this barrier layer is a vapour-deposited glass layer substantially composed of $SiO_x$, x ranging from 1.2. to 1.8. Such a barrier layer can be applied to one of or to both outermost sides of the complete finished heat mode element of the present invention, or to one of or to both sides of the support of the recording element before the element is further produced.

For the formation of a heat mode image using the element of the present invention any laser can be used which provides enough energy needed for the production of sufficient heat for this particular process of image formation. In a preferred embodiment a powerful infra-red laser is used. Most preferably a Nd-YLF laser is used emitting at 1053 nm.

The present invention will be illustrated now by the following example without however being limited thereto.

EXAMPLE

Preparation of Heat Mode Recording Elements

The following substrates for the deposition of a bismuth layer were prepared:

reference 1 (R-1): this substrate consisted of a polyethylene terphthalate support sheet subbed with a layer containing 0.16 g/m$^2$ of a copolymer consisting of 88 mole % of vinylidene chloride, 10 mole % of methylacrylate and 2 mole % of itaconic acid, serving as a binder, and also containing 0.04 g/m$^2$ of $SiO_2$ with an average particle size of 0.1 $\mu$m. A backing layer was also present containing, as antistatic element 5.2 mg/m$^2$ of an epoxysilane hydrolyzed in polysulphonic acid, and 5 mg/m$^2$ of $SiO_2$ with an average particle size of 0.1 $\mu$m. This reference 1 element was taken from current manufacturing by Agfa-Gevaert N.V.;

reference 2 (R-2): an aqueous coating solution was prepared containing the same copolymer consisting of 88 mole % of vinylidene chloride, 10 mole % of methylacrylate and 2 mole % of itaconic acid, serving as a binder, and two conventional commercial wetting agents. This solution was coated on top of a subbed polyethylene terephthalate substrate corresponding to reference 1. After drying this extra layer contained 0.45 g/m$^2$ of the copolymer;

invention 1 (I-1): this substrate was similar to reference 2 with the exception that the extra layer contained only 0.16 g/m$^2$ of the copolymeric binder and 0.09 g/m$^2$ of roughening agent ROPAQUE OP62 LO, having an average particle size of 0.5 $\mu$m, purchased from Rohm and Haas Co.

invention 2 (I-2): this substrate was similar to reference 2 with the exception that the extra layer further contained a roughening agent consisting of polymethylmethacrylate beads, having an average particle size diameter of 1.0 $\mu$m, at a coverage of 0.59 g/m$^2$.

To these four substrates a bismuth layer of 0.3 $\mu$m thickness was applied by vacuum-deposition (vacuum of $10^{-2}$ Pa) in a Leybold apparatus, after a weak corona discharge of 0.05 Ampére. To the bismuth layer was laminated in vacuo a protective element consisting of a 8 $\mu$m thick adhesive layer containing copoly(butylacrylate-vinylacetate), and of a cover sheet being a 12 $\mu$m thick polyethylene terephthalate foil.

Image Formation and Evaluation of Image Quality

The four recording elements were exposed by means of a high-power internal drum laser recorder with following characteristics:

laser type: Nd-YLF laser;

wavelength: 1053 nm;

spot diameter (1/e$^2$): 18 $\mu$m;

pitch: 10.58 $\mu$m;

velocity of the rotating scanning mirror: 1663 rpm drum radius: 188.6 mm;

The elements were exposed through the protective laminate side. Full areas and separate scan lines (1 on/10 off) were exposed at different laser powers ranging between 480 mW and 1330 mW. The obtained image quality was evaluated as follows.

(a) Dmax and Dmin

The densities of exposed and unexposed full areas were measured with a MACKBETH TD904 densitometer equipped with a UV-filter and a measuring spot of 3 mm. The results (mean values of different measurements, expressed in thousands) are summarized in table 1.

TABLE 1

| | | Dmin | | | | | |
|---|---|---|---|---|---|---|---|
| element | Dmax | 480 mW | 700 mW | 900 mW | 1110 mW | 1260 mW | 1330 mW |
| R-1 | 362 | 290 | 133 | 53 | 37 | 30 | 29 |
| R-2 | 390 | 345 | 98 | 46 | 35 | 31 | 32 |
| I-1 | 380 | 332 | 142 | 49 | 34 | 32 | 31 |
| I-2 | 289 | 233 | 108 | 49 | 34 | 32 | 31 |

From table 1 it is clear that at least a laser power output, measured on the recording element plane, of 1110 mW is necessary to get a maximal density differentiation between exposed and unexposed areas. At this and above this power the presence or absence of a roughening agent has little influence on Dmin.

(b) Macroscopic Evaluation of Homogeneity

The macroscopic homogeneity was defined as the minimal laser power at which the full areas and lines showed no interference patterns or interference fringes any more. These values are summarized in table 2:

TABLE 2

| | homogeneity | |
|---|---|---|
| element | full areas | lines |
| R-1 | >1330 | >1330 |
| R-2 | >1330 | >1330 |
| I-1 | 1200–1260 | >1330 |
| I-2 | 1110–1200 | 1110–1200 |

The interference phenomena disappeared at a lower laser power the recording elements contained a roughening agent. The best result was obtained with roughening agent polymethylmethacrylate having an average grain size of 1.0 $\mu$m.

(c) Microscopic Evaluation of Homogeneity

The recorded full areas and lines were enlarged 100 fold by means of a Nikon microscope and photographed so that individual scan lines became visible.

An arbitrary qualification ranging from 0 to 5 was assigned to the physical quality of the recorded full areas at 1200 mW power and 1330 power. This qualification range had following meaning:

1: inhomogeneous, very intense interference spots;

2: inhomogeneous, rather intense interference spots;

3: rather homogeneous, still slight interference;

4: practically completely homogeneous; sometimes very slight interference;

5: very homogeneous; no interference.

The quality results are summarized in table 3 :

TABLE 3

| element | quality at 1200 mw | quality at 1330 mW |
|---|---|---|
| R-1 | 1 | 2 |
| R-2 | 2 | 3 |
| I-1 | 4 | 5 |
| I-2 | 5 | 5 |

The table clearly illustrates the superior results obtained with the elements according to the present invention.

The recorded lines showed local variations in width due to local variations of laser power as a consequence of interference. Table 4 summarizes the minimal and maximal values of the line width (in $\mu$m) obtained with laser powers varying between 1110 and 1330 mW.

TABLE 4

| | elements | | | |
|---|---|---|---|---|
| Power | R-1 min-max | R-2 min-max | I-1 min-max | I-2 min-max |
| 1010 | 0–8 | 0–8 | 7–10 | 7–9 |
| 1110 | 0–8 | 5–11 | 7–10 | 8–9 |
| 1200 | 3–10 | 7–11 | 7–11 | 9.5-10 |
| 1260 | 5–11 | 7–11 | 9–12 | 10–11 |
| 1300 | 7-11.5 | 10–12 | 11–13 | 11-11.5 |
| 1330 | 7–12 | 10–12 | 11–13 | 11–12 |

It is clear from the table that the difference between minimal and maximal line width is smaller with the elements according to the invention.

What is claimed is:

1. Heat mode recording element comprising, in order:

(a) a support, (b) a layer containing a roughening agent, (c) a metal recording layer, (d) a protective element.

2. Heat mode recording element according to claim 1 wherein said layer containing a roughening agent has a $R_a$ value of at least 0.2 $\mu$m.

3. Heat mode recording element according to claim 1 wherein said roughening agent has an average particle size between 0.3 and 2.0 $\mu$m.

4. Heat mode recording element according to claim 3 wherein said roughening agent having an average particle size between 0.3 and 2.0 $\mu$m is present in layer (b) at a coverage between 0.05 and 1.0 g/m$^2$.

5. Heat mode recording element according to claim 1 wherein said roughening agent is polymethylmethacrylate.

6. Heat mode recording element according to claim 1 wherein said metal recording layer is a bismuth layer.

7. Heat mode recording element according to claim 6 wherein said bismuth layer has a thickness between 0.05 and 0.6 $\mu$m.

8. Heat mode recording element according to claim 1 wherein said support is provided with a subbing layer and said layer (b) containing a roughening agent is said subbing layer.

9. Heat mode recording element according to claim 1 wherein said protective element comprises a polymeric cover sheet or layer being a transparent polymeric resin, and an adhesive layer.

10. Method for the formation of a heat mode image comprising exposing information-wise by intense laser radiation a heat mode recording element according to claim 1.

11. Method according to claim 10 wherein said intense laser radiation is produced by an infra-red laser.

* * * * *

UNITED STATES PATENT AND TRADEMARK OFFICE

CERTIFICATE OF CORRECTION

PATENT NO. : 6,309,808 B1
DATED : October 30, 2001
INVENTOR(S) : Dirk D'hont et al.

It is certified that error appears in the above-identified patent and that said Letters Patent is hereby corrected as shown below:

Title page,
"[73] Assignee: Agfa-Cevaert, Mortsel (BE)" should read:
-- [73] Assignee: Agfa-Gevaert, Mortsel (BE) --;

Column 8,
Line 36, after "power" insert -- when --;
Line 45, "1330" should read -- 1330 mW --;

Column 10,
After claim 11, insert the following:

-- 12. Method according to claim 11 wherein said infra-red laser is a Nd-YLF laser emitting at 1053 nm. --

Signed and Sealed this

Twenty-fifth Day of June, 2002

*Attest:*

*Attesting Officer*

JAMES E. ROGAN
*Director of the United States Patent and Trademark Office*